US006393640B1

(12) United States Patent
Dalis

(10) Patent No.: US 6,393,640 B1
(45) Date of Patent: May 28, 2002

(54) MATTRESS PAD AND POCKET COMBINATION

(76) Inventor: Nina B. Dalis, 1419 Mount Olive Dr., Moody, AL (US) 35004

( * ) Notice: Subject to any disclaimer, the term of this patent is extended or adjusted under 35 U.S.C. 154(b) by 0 days.

(21) Appl. No.: 09/552,789

(22) Filed: Apr. 20, 2000

(51) Int. Cl.[7] ..... A47C 27/10

(52) U.S. Cl. ..... 5/497; 5/655.5; 5/909; 5/691

(58) Field of Search ..... 5/484, 485, 497, 5/909, 654, 644, 699, 655.5, 655.3, 706, 707, 691, 676

(56) References Cited

U.S. PATENT DOCUMENTS 3,654,646 A 4/1972 McMahon, Jr.
4,825,489 A 5/1989 Ross
4,962,546 A * 10/1990 Vitale ..... 5/500
5,189,744 A * 3/1993 Roberts ..... 5/497
5,287,574 A 2/1994 Kardell et al.
5,325,555 A 7/1994 Whitley
5,636,395 A * 6/1997 Serda ..... 5/691
D385,144 S 10/1997 Kozole et al.

* cited by examiner

*Primary Examiner*—Lynne H. Browne
*Assistant Examiner*—Fredrick Conley

(57) ABSTRACT

A mattress pad and pocket combination for holding a pad in place on a mattress. The mattress pad and pocket combination includes a pad and a pocket. The pad has a distal edge, a proximal edge and pair of side edges. The pocket has a bottom wall, a back wall and a pair of side walls. Each of the back and side walls has a top edge. The top edge of the back wall is fixedly coupled to the proximal edge of the pad. Each of the top edges of the side edges is fixedly coupled to one of the side edges of the pad. The pocket is placed over a proximal end of a mattress.

4 Claims, 2 Drawing Sheets

MATTRESS PAD AND POCKET COMBINATION

BACKGROUND OF THE INVENTION

1. Field of the Invention

The present invention relates to mattress pads and more particularly pertains to a new mattress pad and pocket combination for holding a pad in place on a mattress.

2. Description of the Prior Art

The use of mattress pads is known in the prior art. More specifically, mattress pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,189,744; U.S. Pat. No. 5,442,822; U.S. Pat. No. 4,964,184; U.S. Pat. No. 5,008,966; U.S. Pat. No. 4,308,626; U.S. Pat. No. 4,962,546; U.S. Pat. No. 5,325,555; U.S. Pat. No. 3,654,646; U.S. Des. Pat. No. 385,144; U.S. Pat. No. 4,825,489; U.S. Pat. No. 5,287,574 and U.S. Des. Pat. No. 372,622.

While these devices fulfill their respective, particular objectives and requirements, the aforementioned patents do not disclose a new mattress pad and pocket combination. The inventive device includes a pad and a pocket. The pad has a distal edge, a proximal edge and pair of side edges. The pocket has a bottom wall, a back wall and a pair of side walls. Each of the back and side walls has a top edge. The top edge of the back wall is fixedly coupled to the proximal edge of the pad. Each of the top edges of the side edges is fixedly coupled to one of the side edges of the pad. The pocket is placed over a proximal end of a mattress.

In these respects, the mattress pad and pocket combination according to the present invention substantially departs from the conventional concepts and designs of the prior art, and in so doing provides an apparatus primarily developed for the purpose of holding a pad in place on a mattress.

SUMMARY OF THE INVENTION

In view of the foregoing disadvantages inherent in the known types of mattress pads now present in the prior art, the present invention provides a new mattress pad and pocket combination construction wherein the same can be utilized for holding a pad in place on a mattress.

The general purpose of the present invention, which will be described subsequently in greater detail, is to provide a new mattress pad and pocket combination apparatus and method which has many of the advantages of the mattress pads mentioned heretofore and many novel features that result in a new mattress pad and pocket combination which is not anticipated, rendered obvious, suggested, or even implied by any of the prior art mattress pads, either alone or in any combination thereof.

To attain this, the present invention generally comprises a pad and a pocket. The pad has a distal edge, a proximal edge and pair of side edges. The pocket has a bottom wall, a back wall and a pair of side walls. Each of the back and side walls has a top edge. The top edge of the back wall is fixedly coupled to the proximal edge of the pad. Each of the top edges of the side edges is fixedly coupled to one of the side edges of the pad. The pocket is placed over a proximal end of a mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mattress pad and pocket combination apparatus and method which has many of the advantages of the mattress pads mentioned heretofore and many novel features that result in a new mattress pad and pocket combination which is not anticipated, rendered obvious, suggested, or even implied by any of the prior art mattress pads, either alone or in any combination thereof.

It is another object of the present invention to provide a new mattress pad and pocket combination which may be easily and efficiently manufactured and marketed.

It is a further object of the present invention to provide a new mattress pad and pocket combination which is of a durable and reliable construction.

An even further object of the present invention is to provide a new mattress pad and pocket combination which is susceptible of a low cost of manufacture with regard to both materials and labor, and which accordingly is then susceptible of low prices of sale to the consuming public, thereby making such mattress pad and pocket combination economically available to the buying public.

Still yet another object of the present invention is to provide a new mattress pad and pocket combination which provides in the apparatuses and methods of the prior art some of the advantages thereof, while simultaneously overcoming some of the disadvantages normally associated therewith.

Still another object of the present invention is to provide a new mattress pad and pocket combination for holding a pad in place on a mattress.

Yet another object of the present invention is to provide a new mattress pad and pocket combination which includes a pad and a pocket. The pad has a distal edge, a proximal edge and pair of side edges. The pocket has a bottom wall, a back wall and a pair of side walls. Each of the back and side walls has a top edge. The top edge of the back wall is fixedly coupled to the proximal edge of the pad. Each of the top edges of the side edges is fixedly coupled to one of the side edges of the pad. The pocket is placed over a proximal end of a mattress.

Still yet another object of the present invention is to provide a new mattress pad and pocket combination that has a pocket which will slip over the head, or proximal portion of a bed so that the pad does not slide off of the bed when the bed is in a raised or angled configuration.

Even still another object of the present invention is to provide a new mattress pad and pocket combination that that may be easily modified for any bed and helps prevents injuries which occur from refitting mattress pads.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
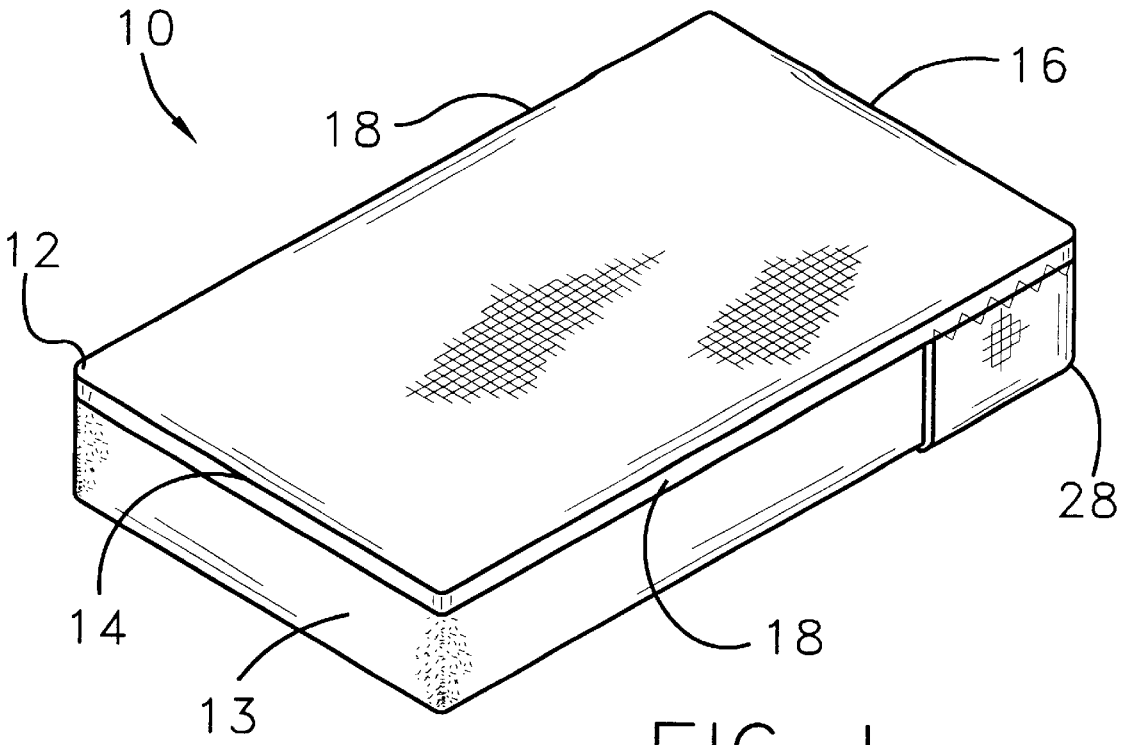
FIG. 1 is a schematic perspective view of a new mattress pad and pocket combination according to the present invention.
Figure 2:
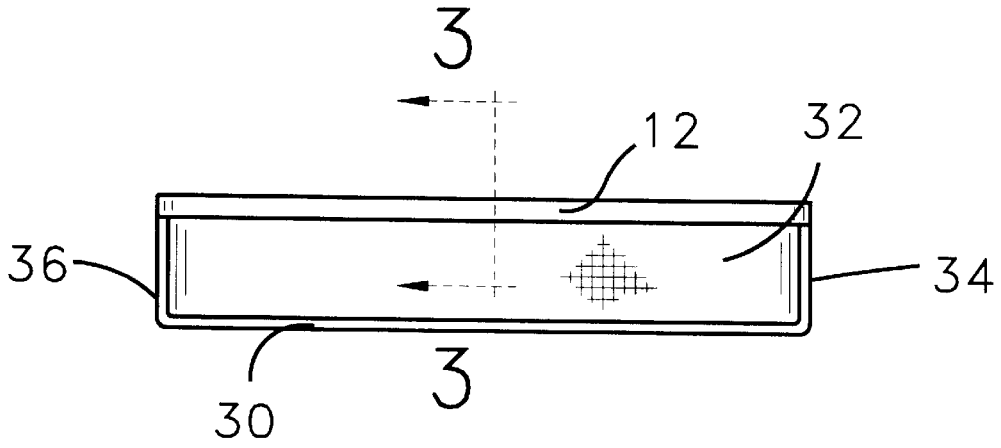
FIG. 2 is a schematic end view of the present invention.
Figure 3:
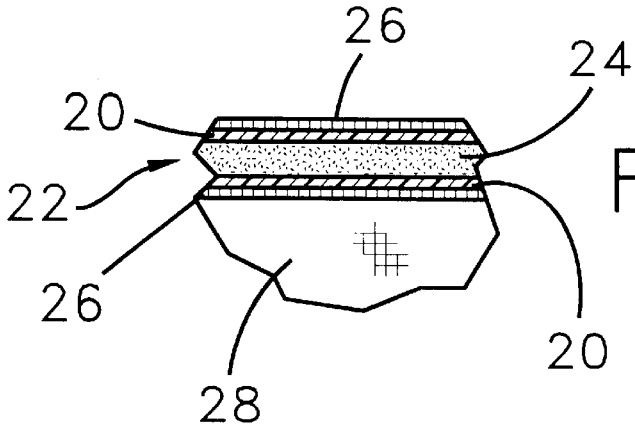
FIG. 3 is a schematic cross-sectional view taken along line 3—3 of the present invention.

With reference now to the drawings, and in particular to FIGS. 1 through 4 thereof, a new mattress pad and pocket combination embodying the principles and concepts of the present invention and generally designated by the reference numeral 10 will be described.

As best illustrated in FIGS. 1 through 4, the mattress pad and pocket combination 10 generally comprises a pad 12 having a pocket 40 coupled thereto. The pad 12 will have a length and width substantially equal to the length and width of the mattress 13 on which it is to be placed. The pad 12 has a distal edge 14, a proximal edge 16 and pair of side edges 18. The pad 12 has an inner lining 20. The inner lining 20 has a top panel, a bottom panel and a peripheral panel integrally coupled therebetween such that a cavity 22 is defined between the top and bottom panels. The cavity 22 may be divided into a plurality of cavities. The inner lining 20 is substantially water-proof and is made from a conventional waterproof flexible material.

A gelatinous material 24 is in the cavity 22, or plurality of cavities, such that a substantial portion of the cavity 22 is filled with the gelatinous material. The gelatinous material 24 is substantially viscous such that it does not easily move throughout the cavity 22. The gelatinous material 24 may be any conventional gel used in bed devices to give comfort to aid burn victims or others that are bed ridden. Ideally the gelatinous material will have a density relatively equal to that of human adipose tissue.

The pad 12 has an outer lining 26. The outer lining 26 encases the inner lining 20 and makes it more comfortable for the user. The outer lining 26 comprises a cloth material. Ideally the cloth material is selected from the group comprising cotton, silk, and synthetic material. The outer lining may be replaced by a sheet which could be placed over the pad 12.

The pocket 28 has a bottom wall 30, a back wall 32 and a pair of side walls 34, 36. Each of the back 32 and side walls 34, 36 has a top edge 38. The top edge 38 of the back wall 32 is fixedly coupled to the proximal edge 16 of the pad 12. Each of the top edges 38 of the side walls 34, 36 is fixedly coupled to one of the side edges 18 of the pad 12. The pocket 28 preferably comprises a cloth material. Ideally an elastic material would be used. The back 32 and side walls 34, 36 each has a height substantially equal to a height of the mattress 13. The side walls 34, 36 preferably have a length generally between one and three feet.

Figure 4:
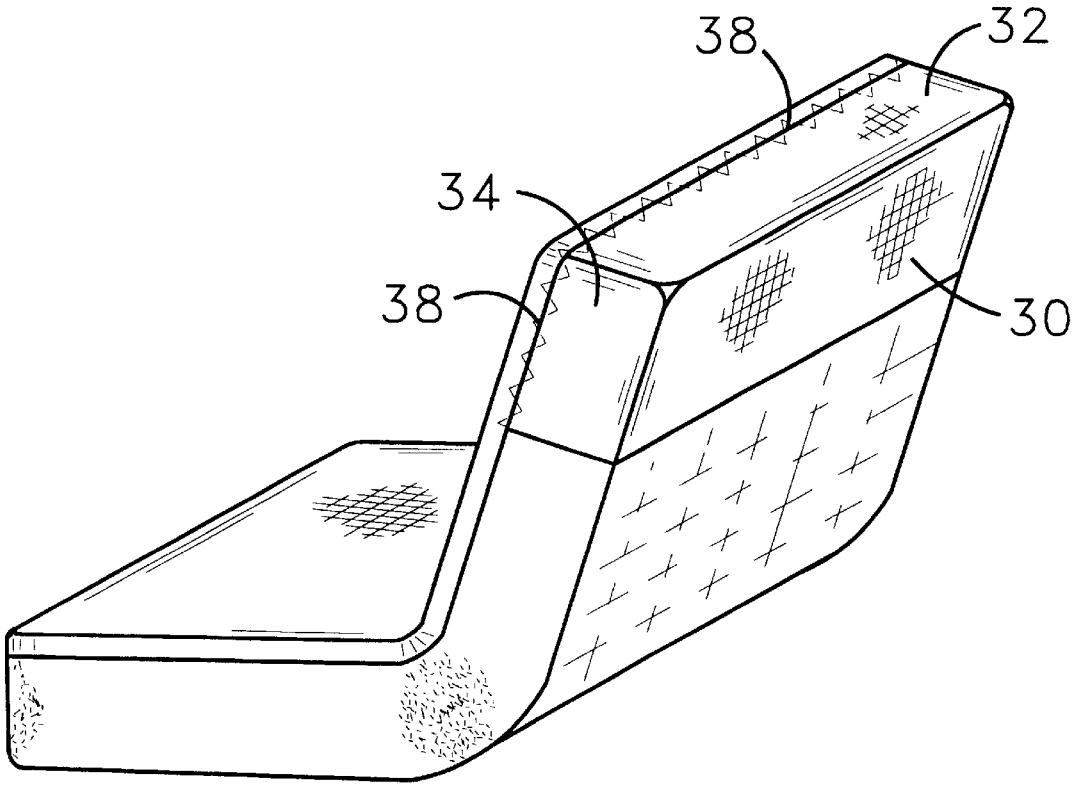
FIG. 4 is a schematic perspective view of the present invention on an inclined mattress.

In use, the pocket 28 is placed over the proximal end of the mattress 13 as shown in FIGS. 1 and 4. The pad 12 is heavy due to the gel 24 found within. The pocket 28 prevents the pad 12 from sliding off of the mattress 13 when the mattress 13 is in a raised position as in FIG. 4.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mattress pad and pocket combination device removably fitting on a mattress, said device comprising:

a pad having a distal edge, a proximal edge and pair of side edges;

a pocket having a bottom wall, a back wall and a pair of side walls, each of said back and side walls having a top edge, said top edge of said back wall being fixedly coupled to said proximal edge of said pad, each of said top edges of said side walls being fixedly coupled to one of said side edges of said pad;

wherein said pocket is positionable over a proximal end of said mattress; and an inner lining having a top panel, a bottom panel and a peripheral panel integrally coupled therebetween such that a cavity is defined between said top and bottom panels, said inner lining being substantially waterproof;

wherein said mattress pad further comprises an outer lining, said outer lining encasing said inner lining, said outer lining comprising a cloth material.

2. The mattress pad and pocket combination device as in claim 1, wherein a gelatinous material is positioned in said cavity such that a substantial portion of said cavity is filled with said gelatinous material.

3. The mattress pad and pocket combination device as in claim 1, additionally comprising a mattress, and wherein said back and side walls of said pocket each have a height substantially equal to a height of said mattress, said side walls having a length generally equal to less than one-half a length of the mattress.

4. A mattress pad and pocket combination device for removably fitting on a mattress, said device comprising:

a pad, said pad having a distal edge, a proximal edge and pair of side edges, said pad comprising:

an inner lining, said inner lining having a top panel, a bottom panel and a peripheral panel integrally coupled therebetween such that a cavity is defined between said top and bottom panels, said inner lining being substantially water-proof;

a gelatinous material, said gelatinous material being in said cavity such that a substantial portion of said cavity is filled with said gelatinous material, said gelatinous material being substantially viscous;

an outer lining, said outer lining encasing said inner lining, said outer lining comprising a cloth material, said cloth material being selected from the group comprising cotton, silk, and synthetic material;

a pocket, said pocket having a bottom wall, a back wall and a pair of side walls, each of said back and side walls having a top edge, said top edge of said back wall being fixedly coupled to said proximal edge of said pad, each of said top edges of said side walls being fixedly coupled to one of said side edges of said pad, said pocket comprising a cloth material, said back and side walls each having a height substantially equal to a height of said mattress, said side walls having a length generally between one and three feet; and wherein said pocket is placed over a proximal end of said mattress.

* * * * *